United States Patent [19]

Roller et al.

[11] Patent Number: 4,580,123

[45] Date of Patent: Apr. 1, 1986

[54] THERMAL PROTECTIVE SWITCH

[75] Inventors: Hanno Roller, Kandel; Roland Starck, Rülzheim, both of Fed. Rep. of Germany

[73] Assignee: Fritz Eichenauer GmbH & Co. KG, Fed. Rep. of Germany

[21] Appl. No.: 619,154

[22] PCT Filed: Jan. 14, 1984

[86] PCT No.: PCT/EP84/00011

§ 371 Date: Jun. 6, 1984

§ 102(e) Date: Jun. 6, 1984

[30] Foreign Application Priority Data

Jan. 15, 1983 [DE] Fed. Rep. of Germany ... 8300960[U]

[51] Int. Cl.[4] ..... H01H 61/02; H01H 71/16

[52] U.S. Cl. ..... 337/103; 337/102

[58] Field of Search ..... 337/102, 103, 107; 338/22 R; 219/511, 505, 504

[56] References Cited

U.S. PATENT DOCUMENTS

| | | | |
|---|---|---|---|
| 3,265,839 | 8/1966 | Johnson | 337/103 |
| 4,177,443 | 12/1979 | Willeke | 337/102 |
| 4,287,500 | 9/1981 | Ueda | 338/22 R |

*Primary Examiner*—Harold Broome

*Attorney, Agent, or Firm*—Antonelli, Terry & Wands

[57] ABSTRACT

Thermal protective switches (1) that are used for limiting the temperature of electrical appliances by automatic opening of the circuit should only reset themselves again after a large change in temperature. In this respect, when the load (9) is overheated, the contact (5') fixed to the bimetallic strip (5) is moved clear of the counter-contact (4) into its open position so that the current through the contact assembly is interrupted. If the fault is not put right there is continuous switching or hunting and there is a danger of the contacts of the thermal protective switch becoming welded to each other. For this reason, for stopping the contacts closing again, the design is such that in the open position the contact assembly, is shunted by the PTC resistor (6). The parts are kept in the open position until the load (9) is turned off by hand.

20 Claims, 11 Drawing Figures

THERMAL PROTECTIVE SWITCH

The invention relates to a thermal protective switch having a contact assembly made up of moving contact with a counter-contact, a bimetallic sensing element for moving the moving contact clear of the counter-contact, and a resistor.

When a fault develops, the first action of known thermal switches is to interrupt the load circuit, for example the circuit of a radiator. After the bimetallic sensing element has cooled down the contacts are moved together and the radiator load circuit is closed again. If the fault or other cause for the thermal protective switch turning off is not taken care of, the switch will open again. Because this may take place at an ever increasing rate, so that the switched-on intervals become shorter and shorter, the bimetallic strip and the contact faces are likely to be damaged by the heating effect of the electric current, the contact assembly no longer being able to take up and dissipate such heat in the desired way. Frequent switching at excessive temperatures may cause the contacts to weld together. Such undesired switching of a thermal protective switch so that it is repeatedly switched on and off is referred to as "hunting". If the contacts are welded together temperature control by thermal protective switch will no longer be possible, because the radiator will be permanently connected with the electricity supply and it will not be switched off by the said thermal protective switch. The load and any other devices in circuit will be irreparably damaged. There will furthermore be a danger of fire because of the failure of the controller.

A further form of known thermal protective switch has so-called thick film resistors in parallel with the contact assembly for keeping the switch from hunting. These thick film resistors are purely ohmic resistors which are produced by screen printing resistance ink on a thermally stable material and baking. The thermal isolation of such resistors and the putting of the metal parts in position is a very complex operation and is frequently not possible. Further shortcomings are that because the resistor is not fully thermally separated or isolated from the contact assembly the resistor has to be run at higher temperatures, which are likely to be responsible for thermal overloading of the resistors themselves and they may then be damaged by the heat generated in them, while further resin components as frequently used in protective switches will become brittle and develop cracks so that they may fracture. The first-noted form of danger is even likely in a design in which an ohmic resistor, which heats itself up, is connected by leads between the two sides of the contact assembly.

Generally speaking, and without paying particular attention to these shortcomings, the use of PTC resistor elements is quite well known. The German unexamined (Offenlegungsschrift) specification No. 2,927,475 is with respect to a controller housed in a glass bulb with a PTC resistor element responding to heat. The resistor element has holes through which electrode leads may be threaded and it is kept in place by such leads. There is no possible chance of being able to dismount the element for replacement. Because of the glass bulb, use for the purpose noted above is not possible. More specially, use in a forced air flow heater would not be possible, because the glass bulb would cut down the heat transfer excessively. The German unexamined specification No. 2,606,201 is with respect to an actuating member with a bimetallic element and a PTC element such that mechanical holding functions such as locking functions are to be possible. Here as well the heat sensitive resistance element may not be replaced. Moreover the flow of heat and the thermal coupling of the PTC element is badly designed in respect of the lever motion. The German unexamined specification No. 2,907,763 is with respect to timer switch for the delayed switching on and off of electrical devices and may be compared with the function of a two pole, two throw switch, it being fitted with a ceramic resistance element functioning as an electromagnet winding. In other respects this design has the same shortcomings as the said German specification No. 2,927,475 because it is encapsulated so that the device is generally not able to be used in the way noted hereinbefore. The East German specification No. 119,497 relates to a bimetallic switch for the thermal protection of electrical devices, in which a homogeneous resistance element is placed one sidedly against the moving part of the bimetal spring and by way of a U-like clip produces an electrical contact with the stationary part of the bimetallic switch and at the same time acts as a support for the resistance element. The resistance element is a thermally stable elastomer with a limited electrical conductivity, more specially silicone rubber. The form of pressing effect is poor in this case, because the u-like bridgepiece loses its gripping effect on being heated. Furthermore the moving part of the controller has a supporting function so that the accuracy of control is likely to suffer.

On the other hand the purpose of the present invention is to further develop a protective device of the sort noted at the start in such a way that while taking care of the shortcomings noted, it is not possible for the device to the switched on again before the fault has been put right, the insulation of the heat energy being produced by simple means in the best possible way in the least space, while at the same time the temperature of the surroundings is kept from rising when there is a fault.

In keeping with the present invention this purpose is effected inasfar as the resistor is a PTC resistor placed on the contact assembly. By using a PTC component as in the invention a dependable, safe and fast transfer of the heat produced by a flow of current to the contact assembly is made certain of. The temperature-resistance function of such a PTC component firstly makes certain that as compared with the opening of the contact assembly because of an excessive ambient temperature the conductivity of the PTC component is so small that there is more or less no further flow of current. When the surroundings cool down the current through the PTC element and the release of heat dependent thereon become stabilized at a value such that the contact assembly is reliably kept open until there is an external interruption of the current, for example through turning off the device or an electrical appliance plug being pulled out. It is only some time later, that is to say only after checking the load and if necessary repairing it before turning on again after the undesired switching off of the load by the protective switch, that the contact assembly of the protective switch will act.

Further useful effects and details of the invention will be seen from the claims and the following detailed account of working examples of the new thermal protective switch.

Figure 1:
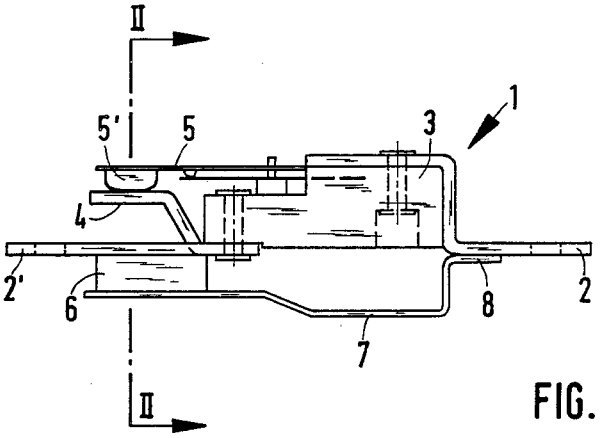
FIG. 1 is a view of a first working example of the new thermal protective switch from the side.

The open thermal protective switch 1 of the invention to be seen in FIG. 1 without a housing has connection and anchoring lugs 2, that are fixed in an insulating part 3 of the thermal protective switch 1. There is furthermore a contact assembly that is composed of a bimetallic strip 5 joined electrically with a contact lug 2 by which it is kept in place. On the end of the strip 5 a button-like contact 5' is fixed functioning with a a counter-contact 4, that is fixed on the other contact lug 2'. The contact lug 2 spring strip 7 is fixed by having a bent part 8 thereof spot-welded on to the contact lug 2. The spring strip 7 runs from this point to a position under the contact lug 2', it being acted upon by a spring force acting towards the contact lug 2'. Between the contact lug 2' and the spring strip 7 a PTC resistor bead 6 is placed, that is only pressed by the spring force of the spring strip 7 against the contact lug 2 and so kept in place. It is important that no further anchoring means be used so that the PTC resistor may be readily and simply replaced.

Figure 3:
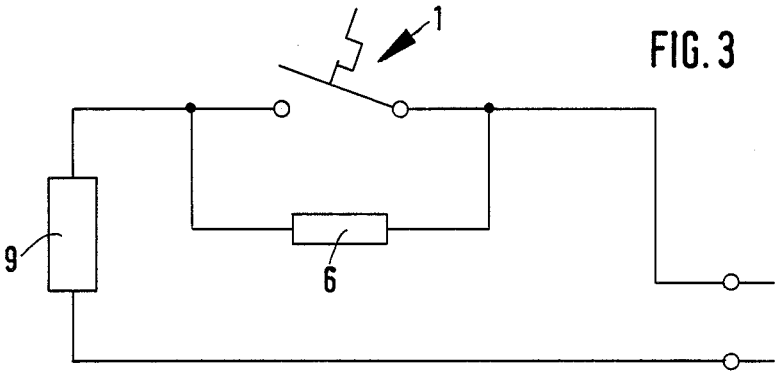
FIG. 3 is schematic of a new thermal protective switch.

The thermal protective switch 1 of the invention is connected in series with a load 9 such as a heater or the like, as will be seen from FIG. 3. It will be clear from the circuit schematic that the PTC resistor 6 is placed in parallel to the contact assembly so that it shunts it. If the current is now turned on, it will go from one connection lug, for example 2, by way of the bimetallic part 5 and the contact 5' fixed thereto to the counter-contact 4 and from same to the connection lug 2' and then to the load 9, which will then for example be heated. If a fault develops, for example because the load 9 is excessively overheated, the bimetallic strip 5 of the thermal protective switch 1, which as is normally the case is placed next to the load 9, will switch off the contact assembly 4 and 5'; that is to say the contact 5' is moved clear of the counter-contact 4. For this reason the current flow through the contact assembly will be interrupted. Because of the effect of the ambient heat given off by the load 9, the PTC resistor as well will have such a low conductivity that it will hardly conduct any current to the load 9 so that the same will now no longer be loaded and the temperature therein will go down. With a fall in the temperature the conductivity of the PTC resistor will however go up so that there will be a self-heating effect therein and so the condition will become stabilized with a small current flow and a level of heating corresponding thereto, the release of heat to the surroundings, more specially in the present working example, to the counter-contact 4 and by way of radiation therefrom to the bimetallic strip 5 being such that the contact assembly 4 and 5' will keep open. For this reason the load may not be overloaded so that any material release of electrical power as heat from the load 9 of the radiator will not be possible. It is only later after turning off the load 9 by hand that the flow of current through the PTC resistor will cease so that same will cool down and the bimetallic strip 5 shuts the contact assembly 4 and 5' and after a certain time, more specially after checking out the fault, the load may be used again. The current still flowing through the PTC resistor 6 when the contact assembly is opened may in the respect be suitably selected.

Figure 2:
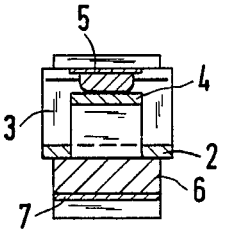
FIG. 2 is a section taken through the switch of FIG. 1 on the line II—II.
Figure 4:
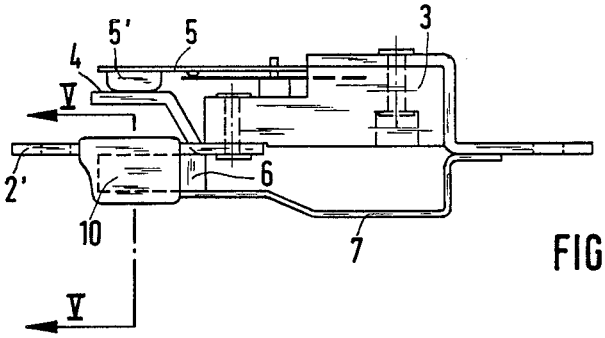
FIG. 4 is a view of a further thermal protective switch in keeping with the present invention.
Figure 5:
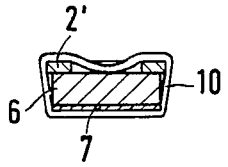
FIG. 5 is a section taken on the line V—V of FIG. 4.

Whereas in the design of FIGS. 1 and 2 the PTC resistor 6 is simply clamped between the connection lug 2' and the spring 7, it may be more securely fixed in place when this is necessary, for example when the appliance in which the thermal protective switch 1 is placed is subject to vibrations. In keeping with the design of FIGS. 4 and 5 a piece of hose 10 with shrink properties is slipped over the connection lug 2', the PTC resistor 6 and the end of the spring 7 holding it and then shrunk onto the parts so that there is now a better heat insulating effect.

Figure 6:
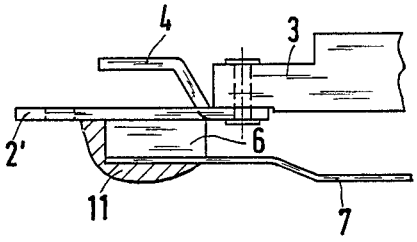
FIG. 6 is a view of a further thermal protective switch in keeping with the invention.

In the design of FIG. 6 the PTC resistor 6 is bonded by adhesive 11, as for example silicone adhesive, on the contact lug 2'. This as well makes for a more secure anchoring effect.

Figure 7:
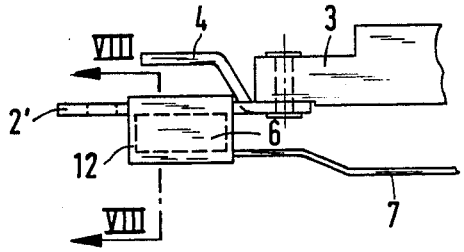
FIG. 7 is a view of a further possible form of the thermal protective switch of the invention.
Figure 8:
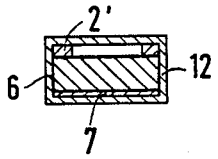
FIG. 8 is a section taken on the line VIII—VIII of FIG. 7.

Another way of fixing is that of the construction of FIGS. 7 and 8. In this case a resin sleeve is drawn over the PTC component 6 to keep it in place and to press it against a contact lug 2'.

Figure 9:
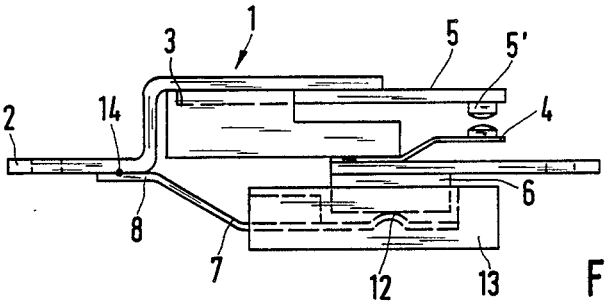
FIG. 9 is a view of a still further thermal protective switch of the invention.
Figure 10:
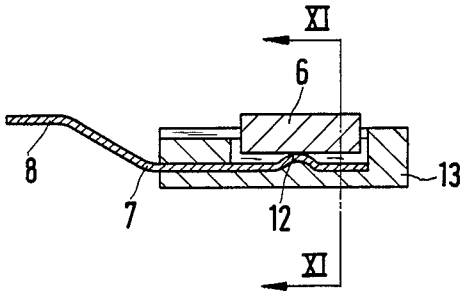
FIG. 10 is a view of the design of FIG. 9 in lengthways section.
Figure 11:
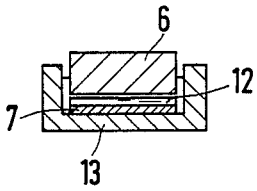
FIG. 11 is a section taken on the line XI—XI of FIG. 10.

A still further preferred form of the thermal protective switch of the invention is to be seen in FIGS. 9 to 11. Inasfar as the parts are the same they are marked with the same part numbers as in the earlier working examples of the invention, to which attention is to be given with respect to parts which are the same and which are not covered here in detail. Unlike the earlier forms of the invention in the design of FIGS. 9 to 11 the spring strip 7 pressing the PTC element 6 against the contact lug 2' has a curved convex embossed part 12 under the PTC element, said part 12 alone touching the PTC element 6; with it the spring 7 presses the PTC element against the contact lug 2. The PTC element 6 may for this reason tip about the pivot-like embossed part 12 and so adjust itself that it is rested flat and evenly on the contact lug 2' on the level. This on the one hand gives a very good thermal insulating effect and on the other an optimum electrical contact so that the function of the thermal protective switch of the invention is fully enabled by this further development thereof, even although the PTC element may nevertheless be simply and readily replaced. In the design of FIGS. 9 to 11 the spring part 7 has furthermore has a bell-like resin part molded round it, the mass of the resin part 13 following the embossed part 12 freely in the bell-like hollow of the part 13. The PTC element is simply placed inside so that it is held at the side by the bell-like form of the resin part 12 against the contact lug 2'. The spring part 7 has its connection part 8 spot welded at 14 to the connection lug 2. The resin used for making the part 13 is Ryton.

The features of the invention given in the above specification, in the figures and in the claims may be used separately or in suitable combinations to put the invention into effect in the different examples thereof.

We claim:

1. A thermal protective switch with a contact assembly comprising a moving contact and a counter-contact, with associated connection lugs arranged to contact each other for conducting current in a circuit, a bimetallic sensing element associated with one of the contact and counter-contact for moving the contact and the counter-contact clear of each other when a fault develops, and a PTC resistor resting against a connection lug of the other of the moving contact and the counter-contact of the contact assembly, wherein the PTC resistor is pressed against the associated connection lug and is thereby fixed to the contact assembly only by an elastic gripping effect caused by a spring means operatively associated with the assembly and the PTC resistor.

2. The thermal protective switch as claimed in claim 1, characterized in that the spring means is fixed to the other connection lug.

3. The thermal protective switch as claimed in claim 1, characterized in that the spring means has a bent part with which it is spot welded on its associated connection lug.

4. The thermal protective switch as claimed in claim 1, characterized in that the spring means is made of stainless spring steel.

5. The thermal protective switch as claimed in claim 1, characterized in that the PTC resistor is placed within a shrink-on hose and is further kept in contact with the associated connection lug by the shrink-on hose.

6. The thermal protective switch as claimed in claim 5, characterized in that the shrink-on hose keeps the PTC resistor, the associated connection lug and the spring means in operative association.

7. The thermal protective switch as claimed in claim 1, characterized in that the PTC resistor is bonded to the associated connection lug.

8. The thermal protective switch as claimed in claim 7, characterized in that the PTC resistor (6) is bonded in place by silicone rubber (11).

9. The thermal protective switch as claimed in claim 1, characterized in that the PTC resistor is fixed in place by a gripping support means between the spring means and its associated connection lug.

10. The thermal protective switch as claimed in claim 9, characterized in that the gripping support means is a heat resistant resin holding part.

11. The thermal protective switch as claimed in claim 10 characterized in that the spring means is in the form of a pivot about which the PTC resistor can rock.

12. The thermal protective switch as claimed in claim 11, characterized in that between the PTC resistor (6) and the spring part (7) there is a convex curved part, more specially in the form of an arc-like convex embossed part (12) of the spring part (7), and the PTC resistor (6) may be so rocked about said part (12) that its surface facing the connection lug (2') is rested flat against same.

13. A thermal protective switch with a contact assembly comprising a moving contact, a counter-contact, a bimetallic sensing element for moving the contact and the counter-contact clear of each other, a PTC resistor electrically connected in parallel with the contact assembly such that the PTC resistor and one of the contact and the counter-contact have a common terminal lug, and spring means operatively associated with the switch for pressing the PTC resistor against the terminal lug by an elastic gripping effect, such that when the contact and counter-contact are separated by a voltage is still applied on the contact and counter-contact, the switch remains open.

14. A thermal protective switch according to claim 13, wherein the spring means is associated with another terminal lug of the contact assembly.

15. A thermal protective switch according to claim 13, wherein a shrink-hose is provided over the PTC resistor, the associated terminal lug, and the spring means so as to keep the resistor and terminal lug in operative association.

16. A thermal protective switch according to claim 13, wherein the PTC resistor is bonded to the terminal lug.

17. A thermal protective switch according to claim 13, wherein the PTC resistor is further fixed in place by a gripping support means between the spring means and the associated terminal lug.

18. A thermal protective switch according to claim 17, characterized in that the gripping support means is a heat resistant resin holding part.

19. A thermal protective switch according to claim 18, wherein the spring means acts as a pivot for the PTC resistor.

20. A thermal protective switch according to claim 19, wherein the spring means includes a convex curved portion about which the PTC resistor pivots.

* * * * *